United States Patent [19]

Hoult

[11] 4,123,322

[45] Oct. 31, 1978

[54] DRAINAGE FOIL ELEMENT HAVING TWO WIRE BEARING PORTIONS

[75] Inventor: David P. Hoult, Wellesley, Mass.

[73] Assignee: Thermo Electron Corporation, Waltham, Mass.

[21] Appl. No.: 809,909

[22] Filed: Jun. 24, 1977

[51] Int. Cl.[2] ..... D21F 1/48

[52] U.S. Cl. ..... 162/352; 162/374

[58] Field of Search ..... 162/217, 351, 352, 374

[56] References Cited

U.S. PATENT DOCUMENTS

| | | | |
|---|---|---|---|
| 2,928,465 | 3/1960 | Wrist | 162/352 |
| 3,027,941 | 4/1962 | Dunlap | 162/352 |
| 3,323,982 | 6/1967 | Hill | 162/352 |
| 3,713,610 | 1/1973 | Grenier | 162/374 X |
| 3,922,190 | 11/1975 | Cowan | 162/352 |
| 3,953,284 | 4/1976 | Evalahti | 162/352 |

*Primary Examiner*—Richard V. Fisher

*Attorney, Agent, or Firm*—Wolf, Greenfield & Sacks

[57] ABSTRACT

A drainage foil providing improved fines retention and drainage stability when used in cooperation with the forming wire of a machine that forms a mat or web from a wet slurry. The foil has two wire-contacting surfaces a fixed distance apart with a suction-forming section and a drainage section between them. Forces effective on the foil during use are balanced so as to minimize torque around the foil mounting means.

5 Claims, 7 Drawing Figures

DRAINAGE FOIL ELEMENT HAVING TWO WIRE BEARING PORTIONS

This invention relates to apparatus and methods for improving and regulating the drainage of water from the forming wire part of web-forming machines, such as Fourdrinier paper machines, and in particular to improvements in drainage foils.

BACKGROUND OF THE INVENTION

In a Fourdriner machine a suspension of fibres or "stock" is discharged through an orifice or "slice" onto a moving endless wire screen or "wire," (the "forming wire"). The greater part of the water associated with the stock as discharged from the slice is drained away through the wire, leaving most of the fibres on the wire in the form of a continuous felted fibre mat or web. Such drainage occurs principally in the vicinity of certain forming wire-supporting means.

In the making of paper on a Fourdrinier machine several problems are current. One of these is the problem of obtaining the necessary drainage of the water from the stock without excessive removal of the fine fibres or "fines" as they are known in the art. Another problem known as "kick-up" that was associated with the use of table rolls was to a degree brought under control with the introduction of drainage foils.

With low speed machines, table rolls provide adequate drainage and sufficient disturbance to aid formation at the wet end of the table. There are two mechanisms for the disturbance. One is the upwash of water into the web at the in-going nip and the second is the acceleration imparted by the rapid changes in wire radius of curvature at the out-going nip. Increasing machine speeds leads eventually to excessive upwash with stock jump and reduced fines retention on the downstream side of the roll. Both mechanisms are important for good formation but when using tablerolls they cannot be easily controlled independently of machine speed or drainage rate.

To overcome the stock-jump instability, stationary foils are used in place of some or all the rolls. They have a more gentle dewatering action and, because of the sharp front edge, do not push any significant amount of water back into the sheet. They pull the wire down under the action of the suction. The wire moves back up after running through the suction region and the resultant forming-wire curvature again causes a disturbance to the sheet. This aids formation but, at high speeds, can again lead to stock-jump. Independent control of drainage rate and disturbance level is still not possible.

Foil-type drainage apparatus for paper-making machines involves one or more drainage or dewatering elements ("foils") disposed one after another in the machine direction in fixed relationship to the Fourdrinier wire and extending across the machine transversely to the direction of wire travel. Depending on the width of the paper being made, the foils can be as long as 30 feet, or more. Examples of two different types of such foils are found, respectively, in U.S. Pat. No. 2,928,465 and 3,323,982. The foils are subject to wear, and for this and other reasons it is desirable that they be exchangeable and hence removably mounted on supports. U.S. Pat. No. 3,713,610 proposes a solution incorporating a dovetail slide on the support and a mating mortise slot in the foil for removal and installation of the foil by sliding it lengthwise, across the direction of wire travel.

Other solutions exist, all generally incorporating supporting means extending transversely of the forming wire for supporting a foil, and means in the foil for fixing the foil to the supporting means. Owing to the force exerted on the foil in one direction by the wire passing over its leading or "sealing" section, followed by the force exerted on the foil by suction in the opposite direction in its suction-forming section, there is a tendency for a dewatering foil in use to twist around its mounting or supporting means, and this contributes to creep of the foil and to wear of both the foil and the forming wire, as well as to instability in the dewatering process.

Foils currently in use have a sharp front edge, a flat leading or "land" surface for supporting or bearing the forming wire and a diverging trailing surface with divergence angle between 0° and 5° for draining water from the wire. The front edge meets the oncoming forming wire with an acute angle which, with the sharp front edge, sheers off the majority of the water hanging under or otherwise protruding from the wire. If more than one foil is used, as in a set or group of foils working together, each foil is separately mounted and each has one front edge, one bearing section and one drainage section; and each is subject in use to forces tending to twist it around its supporting means.

GENERAL NATURE OF THE INVENTION

An improved drainage foil is proposed which incorporates in one structure, arranged for mounting in any known manner, a first forming wire bearing portion, a suction-creating portion trailing the first bearing portion, a second forming wire bearing portion trailing the suction-creating portion, and water drainage means between the first wire bearing portion and the second wire bearing portion. During use of the foil suction forces are located between a pair of bearing forces. The mounting means in the foil is located in a part that in use is remote from the forming wire. The forces that are effective on the foil in use, including drag and water removal force components, produce a minimum of resultant torque around the mounting, or supporting, means.

The improved drainage foil of the invention has several notable features and advantages:

1. The foil has a suction-producing surface followed a fixed distance away by a water shearing edge; a water drainage slot is located between them, so that the water drains through the slot. The wire is supported on front and rear flat "land" surfaces, the suction surface and slot being between them. The rear surface is on a section that is integrally and rigidly connected to the front portion of the foil by a series of thin webs which produce negligible blockage for water flow through the drainage slot. Superior fines retention can be achieved with this arrangement.

2. The foil is more efficient at removing water because of the short distance between the wire supports or "land" surfaces. For best performance, prior-art existing foils must be operated with a minimum spacing of one or two foil blade widths and sometimes more. If all other quantities such as foil divergent angle, stock consistency, wire tension, machine speed, and the like, are held fixed, it is known that the drainage rate decreases with increasing distance between supports.

3. As the distance between the forming wire bearing portions of the foil is reduced, the foil performance becomes less dependent on the wire tension and there is less wire sag between supports. In current (prior-art) foil installations, wire sag reduces the effective foil angle, and drainage can reduce significantly with reduced wire tension.

4. More water will be drained. In the case when two successive foils are used, there will be two shear edges following the suction forming section of the first foil, as will be described in connection with FIG. 5 of the accompanying drawings. The shearing action of the incorporated water-shearing edge immediately following the suction forming section is independent of the spacing of or distance to a following foil, unlike current foil designs which have only one water-shearing edge per foil. The enhanced ability of the incorporated shear edge immediately following the suction-forming section in the same foil to shear off more water than the shear edge at a following foil comes about because the mat being formed on the forming wire will be more compressed in the vicinity of the incorporated shear edge than it will be further away in the vicinity of the following foil. If the water under the wire is not sheared off until the wire reaches the shear edge of the following foil, the mat will have had time to expand and pull some water back through the forming wire.

5. Because of the incorporation of an integral rear support for the forming wire, the foil can have, effectively, a zero resultant torque around its mounting means. The force due to wire drag is still present but this is a small force component. The locking device for the foil on its mount can be much less critical in design than with the prior-art foils because the forming wire geometry relative to the suction-producing section is largely fixed by the front and rear forming-wire supports. Any tendency of presently available prior-art foils to rotate on their mounts results in a reduction in the effective foil angle, and consequently a reduction in drainage. The balanced torque which is contributed by the present invention also will result in less creep in the polyethylene material used at present as the body material of many drainage foils.

6. Because the forming-wire support loads are divided more or less evenly between the two support surfaces and because the rate of wear is roughly porportional to the pressure of the load on a surface, the rate of wear of foils of the invention will be considerably less than that of a conventional design with the same drainage rate.

7. Because the foil is less sensitive to wire tension, it is possible to extend wire life by reducing tension provided other table factors permit this. The second or rear forming wire support section can be made adjustable in position relative to the first or front forming wire support section, enabling wire support loads to be balanced, and tension to be reduced further.

DETAILED DESCRIPTION OF THE DRAWING

Figure 1:
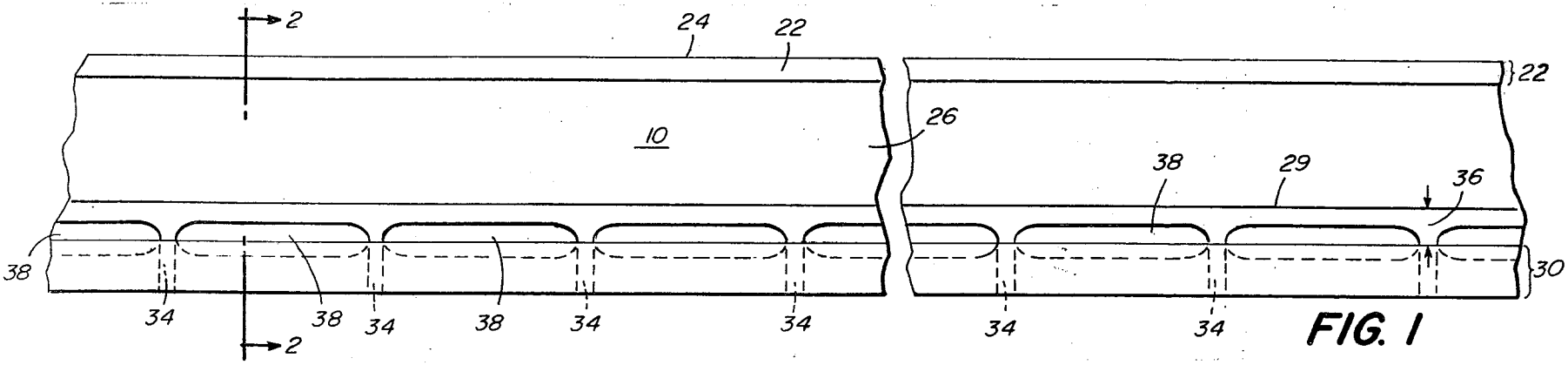
FIG. 1 is a partial plan view of a foil according to the invention.
Figure 3:
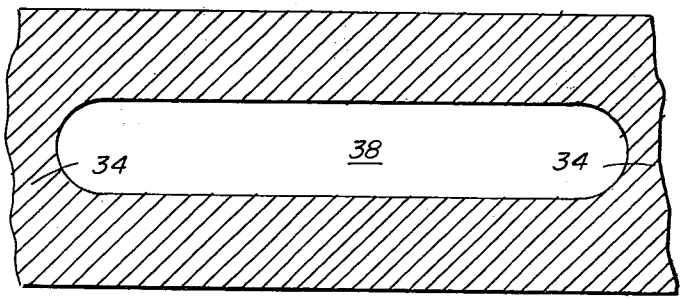
FIG. 3 is a further enlarged section on line 3—3 of FIG. 2.
Figure 2:
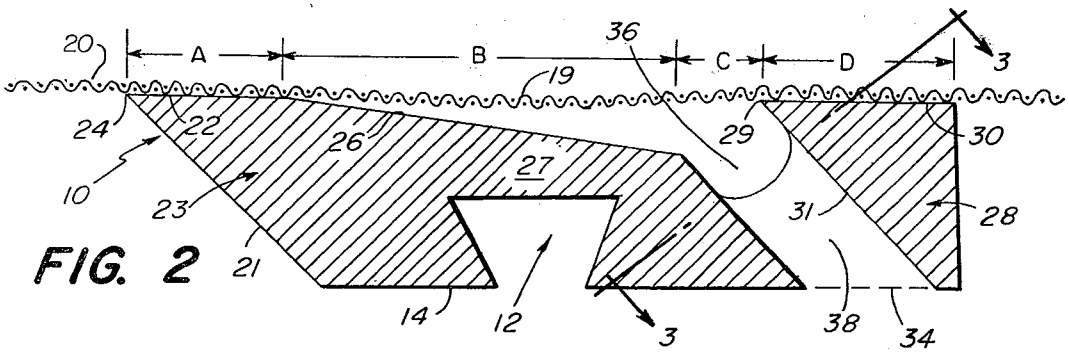
FIG. 2 is an enlarged cross-section on line 2—2 of FIG. 1, showing a forming wire in relation to the foil.

FIGS. 1, 2 and 3 illustrate a first embodiment of the invention. The drainage foil 10 has a known mounting means 12 in the form of a mortise slot running the full length of the foil in the lower portion and opening through the bottom surface 14. This slot can cooperate with mounting means according to U.S. Pat. No. 3,713,610. Those skilled in the art will recognize that other forms of mounting a foil to a support are known in the art and can be used in place of the illustrated arrangement. The top part of the foil will be located in use adjacent (typically, as in a Fourdrinier machine, under) a forming wire 20, to which the foil normally (according to the prior art) provides bearing support at a first bearing surface 22 on a first forming wire bearing section 23 which extends along the foil from the leading edge 24 to the drainage surface 26 on a suction-forming section 27, the width of the bearing surface being marked "A" in FIG. 2, and the width of the drainage surface 26 being marked "B." The foil according to the invention has integrally incorporated in the same foil structure 10 a trailing portion 28 providing a second bearing surface 30 extending rearward from a leading edge 29, to support the forming wire 20 after it leaves the suction-forming section 27, the width of the second bearing surface being marked "D" in FIG. 2. The trailing portion 28, constituting a second forming wire bearing section, is fixedly held separated from the first forming wire bearing section 23 by webs 34 connecting the trailing portion to the suction-forming section 27. A slot 36 extending the full length of the foil between the rear-most boundary of the suction-forming section 27 and the forward-most boundary of the trailing portion 28 communicates with an array of elongated holes 38, one of which is shown greatly enlarged in FIG. 3, separated one from the other by the webs 34, through which water drawn from the wire 20 in the suction forming section 27 can be drained away. The width of the slot 36 is marked "C" in FIG. 2. The holes 38 should be made sufficiently large so that they will not plug with fines drawn out of the web or mat (not shown) being formed on the wire. For example (and not by way of limitation) it has been noted that an array of round holes $\frac{3}{8}$ inch in diameter and $\frac{5}{8}$ inch between centers did tend to plug, in addition to being more expensive to construct than the configuration illustrated in FIGS. 1, 2 and 3. The material of which the new foil 10 is made can be any of the materials suitable for making prior art foils incorporating only the first bearing section 23 and the suction-forming section 27; polyethylene is mentioned above.

The foil 10 has two leading edges 24 and 29, one at each of the forming wire bearing or support surfaces 22, 30, respectively. Each leading edge is formed by two surfaces meeting at an acute angle; being the front surface 21 with the bearing surface 22 of the first bearing portion 23; and the front surface 31 with the bearing surface 30 of the second bearing portion 28. The two leading edges are separated by a fixed distance (A, B and C in FIG. 2), and each functions to shear water from the underside of the forming wire 20. Water drained from the forming wire in the suction-forming section and water sheared from the forming wire at the second leading edge 29 drains away through the slot 36 and holes 38.

The two bearing sections 23 and 28 support the forming wire 20 on their front and rear support or "land" surfaces 22, 30, respectively. The forming wire 20 sags between them in the region 19 under the suction force produced by the downwardly sloping drainage surface 26, but in the present invention the amount of wire sag is restricted by the second or rear bearing section 28. For a given forming wire tension (all other relevant factors being equal) the amount of wire sag is less than would occur between two successive prior art foils. This enables the forming wire to be operated with reduced tension, for a given amount of wire sag. An advantage of operating the forming wire with reduced tension is to extend its useful life.

When water is drawn from a web or mat of papermaking slurry being carried on the forming wire 20, the mat will squeeze down a bit over the suction-forming section 27 as water is pulled from it by the suction. As the wire leaves the suction-forming section the mat will expand tending to pull back into itself water that is hanging under the wire. In the present invention the second edge 29 is in position immediately following the drainage slot 36, at the fixed distance C from the drainage surface 26, where it can shear water from the underside of the wire 20 before the web on top of the wire can expand and retrieve that water. One foil of the present invention is more efficient in removing water than are two successive foils according to the prior art. As is noted above, it is known in the art that for best performance, existing foils must be operated with a minimum spacing of one or two foil blade widths, and sometimes more, between successive foils.

By reason of the constant distance (B + C) between the front support surface 22 and the second leading edge 29, and the two fixed support surfaces 22 and 30, the amount of sag in the wire 20 over the drainage surface 26 can be maintained within smaller limits than have up to now been possible. The effective foil angle between the wire and the drainage surface is thus maintained more nearly constant during use of the foil and, in turn, this assures a greater degree of stability of the dewatering function in a paper making or other web-forming process.

A contributing factor to the lack of stability of the dewatering process is the tendency of prior art drainage foils to twist around their mounting means. In use, the suction produced over the sloping drainage surface 26 tends to pull the trailing edge of a prior art foil up to the wire, as well as to pull the wire down to the foil. In addition, the downward force exerted by the wire on the front support surface tends to push the foil down toward its mounting structure. Thus, referring to FIG. 4, the prior art foil is pushed downward with a force represented by a downward-pointing arrow 41, and it is pulled upward with a force represented by an upward-pointing arrow 43, the result of which (in the prior art) is to create a force tending to rotate the foil (counterclockwise in FIG. 4) around its mounting means, as is suggested by a curved arrow 45 bending around a little circle 47 representing a pivot point located in the mounting means (12 in FIG. 2). When that happens, the effective foil angle between the wire 20 and the drainage surface 26 is reduced, and the magnitude of the suction force is reduced, with a resultant reduction in drainage.

In the present invention the rear support section 28 is subjected to a downwardly directed force represented by a downward-pointing arrow 49, creating a force tending to rotate the foil around its mounting means (clockwise in FIG. 4) as represented by a second curved arrow 51 pointing opposite to the first curved arrow 45. The two downward forces 41 and 49 are on opposite sides of the suction force 43 and in the opposite direction to it, and this arrangement minimizes the resultant torque force around the mounting means, thereby largely removing the tendency of prior-art foils to reduce the magnitude of the suction force. In this way, the prior art defect that contributed to drainage instability can be minimized and with adequate care eliminated in some installations.

Figure 4:
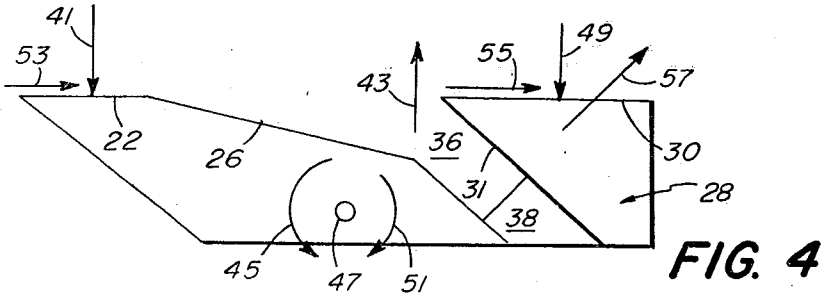
FIG. 4 is a schematic illustration of the dynamic forces that are effective on the foil during use.

During operation of the foil there are additional forces on the foil, as is illustrated in FIG. 4. The forming wire produces a drag force on each of the support surfaces 22 and 30, as is indicated by two arrows 53, 55, respectively. The water being drained through slot 36 and holes 38 impinges on the front wall 31 of the rear support section 28, creating a water removal force directed substantially perpendicular to that surface as is represented by an arrow 57. The force of wire drag 53, 55, tends to enhance the clockwise-twist force 51, but the force contributed by wire drag is relatively small. The force 57 contributed by draining water has a small net effect on the twisting forces (45, 51) because it can contribute to each twisting force. The foil can be designed so that in a given installation and under a given set of operating conditions the resultant torque is substantially zero. This result is not possible with prior art foils. An additional benefit of small torque around the foil mount, approaching zero in magnitude, is that the requirements placed on devices for removably locking a foil on its mounting means become much less critical. The forming wire geometry relative to the suction-producing surface 26 is largely fixed by the front and rear supports 23 and 28, and the mounting and locking mechanisms do not have to contribute to the stability of that geometry.

The advantages of the invention are thus seen to contribute to each other. With a stabilized foil there is a still further advantage that, when a plastics material such as polyethylene is used to make the foil, the tendency of that material to creep is minimized.

Preferably, the load forces 41 and 49 imposed by the forming wire on the support sections 23 and 28 are divided evenly between those sections. In this way, the rate of wear of the foil will be less than that of a conventional prior art foil with the same drainage rate.

Figure 5:
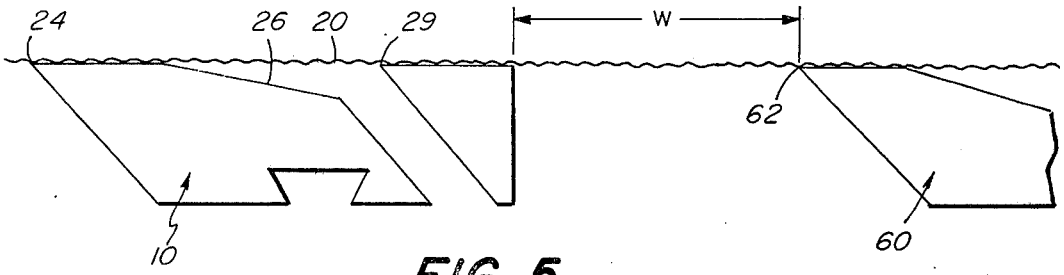
FIG. 5 is a schematic illustration of two foils fixed in position one after another under a forming wire.

FIG. 5 illustrates the positioning of two successive foils 10 and 60 under the forming wire 20. As is noted above, the second or following foil 60 should, for best operation, follow the first foil by at least one foil width "W". With this arrangement, employing the present invention in at least the first foil, more water will be drained from the wire 20 than with two conventional prior-art foils similarly placed relative to each other and the wire. Following the drainage surface 26 there are now two sharp edges 29 and 62 for shearing water off the bottom surface of the wire 20. As is described above, the first of these edges provides a shearing action that is independent of the spacing W of the succeeding foil 60 behind the first foil 10, and owing to the still-compressed condition of the mat (not shown) on the wire 20 when it reaches the shear edge 29 immediately following the drainage surface 26 more water will be available under the wire to be sheared off the wire than would be available later a greater distance away. On the other hand, if the nearby shear edge 29 were absent (as in the prior art) the mat would be given an opportunity to expand and pull some water back into itself throught the forming wire before reaching the shear edge 62 of the succeeding foil 60 a greater distance away.

Figure 6:
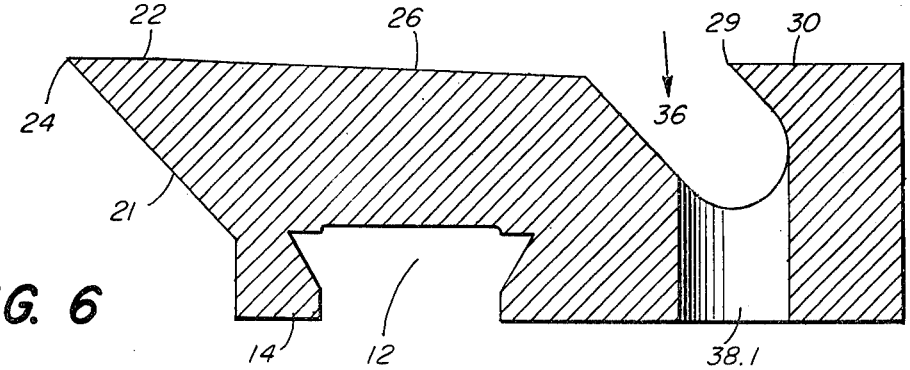
FIG. 6 is a cross-section of an alternate embodiment of the foil shown in FIG. 2.

In FIG. 2 the drainage holes 38 are oriented, like the slot 36, at an angle to the support surfaces 22, 30 and the bottom surface 14. FIG. 6 illustrates an alternative construction in which the drainage holes 38.1 are oriented perpendicular to those surfaces, so that water drained through them will de discharged more nearly downward when the foils are used under a Fourdrinier table wire. Otherwise FIGS. 2 and 6 are alike.

Figure 7:
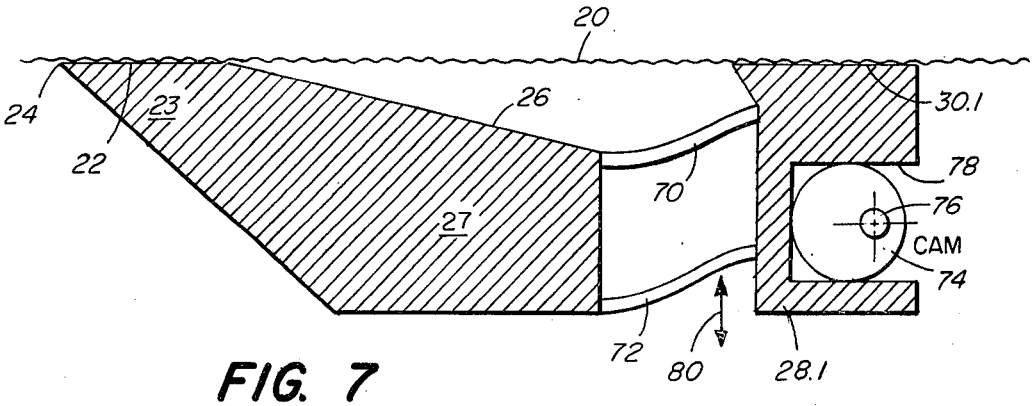
FIG. 7 is a cross-section of another embodiment of the foil of the invention incorporating means to adjust the position of one part relative to another.

FIG. 7 shows schematically a foil according to the invention in which the second or rear bearing section 28.1 is adjustably fastened by paris of flexible attaching members 70, 72 (only one pair being shown) to the suction-forming section 27 of the forward part incorporating the first bearing section 23 and the suction-forming section. The attaching members 70 and 72 are spaced apart in the cross-machine directions, so that water can drain between them. Pairs of attaching member are used in a parallelogram arrangement so that the rear bearing section 28.1 can be moved toward or away from the forming wire 30, relative to the forward sections 23, 27, without changing the orientation of the second bearing surface 30.1. A slot 78 in the rear bearing section 28.1 receives a cam 74 which is rotatable on an off-center axis 76 (fixed in any suitable manner relative to the forward sections 23, 27), for adjusting the second bearing surface 30.1 toward or away from the wire relative to the first bearing surface 22, as is represented by a double-headed arrow 80 in FIG. 7. Each flexible support 70, 72 may be a continuous web with apertures through it for water drainage; or an array of flexible rod-like support elements can be used, spaced apart side-by-side in the cross-machine direction.

While the drainage surface 26 on the suction-forming section 27 has been illustrated as flat, it will be realized that the suction-forming section can be fitted with drainage surfaces of any desired form or shape, and the invention is not limited to any particular form of suction-forming mechanism.

I claim:

1. A drainage foil element for removable attachment to a web-forming machine having a forming wire and support means for said element extending transversely of said forming wire for supporting said foil element in working relation to said forming wire, said foil element comprising in a unitary structure: a part for confronting said forming wire in use, said part having a first forming wore bearing portion, a suction-creating portion trailing said first bearing portion, a second forming wire bearing portion affixed to and trailing said suction-creating portion, and drainage means between said suction-creating portion and said second bearing portion, whereby during use of said foil element the suction force created by said suction-creating portion is located between a pair of bearing forces imposed by said forming wire on said respective wire bearing portions and located in a part of said element that in use is remote from said forming wire; and mounting means extending lengthwise of said foil for fixing said foil element to said support means, said mounting means being located in said foil element between said wire bearing portions so that the respective torques around said support means produced by said bearing forces are in opposite directions.

2. A drainage foil according to claim 1 wherein each of said bearing portions has a front edge formed at an acute angle for shearing water from said forming wire.

3. A drainage foil according to claim 1 wherein said drainage means comprises means defining a slot between said suction-creating portion and said second bearing portion, and beneath said slot, apertured means for holding said second bearing portion in a fixed position trailing said suction-creating portion.

4. A drainage foil according to claim 1 including means to adjust the position of said second forming wire bearing portion relative to said first forming wire bearing portion.

5. A drainage foil according to claim 3 wherein said drainage means is apertured sufficiently large so as to minimize plugging with solid material entrained in the drainage from said forming wire.

* * * * *